United States Patent [19]

Hughes

[11] 3,938,445

[45] Feb. 17, 1976

[54] TRACKWAY FOR OVERHEAD TRANSPORTATION SYSTEM

[76] Inventor: James A. Hughes, 3815 Avenue E, Kearney, Nebr. 68847

[22] Filed: Dec. 5, 1974

[21] Appl. No.: 529,731

[52] U.S. Cl. ..... 104/124; 104/23 FS; 104/89; 104/125; 104/134; 308/5 R

[51] Int. Cl.[2] ..... E01B 25/22; B61B 13/08

[58] Field of Search ..... 104/23 R, 23 FS, 89, 134, 104/138 R, 139, 140, 155, 156, 157, 158, 159, 124, 125; 105/64 J; 308/5 R; 184/5, 100

[56] References Cited

UNITED STATES PATENTS

| | | | |
|---|---|---|---|
| 1,037,973 | 9/1912 | Pages | 104/23 R |
| 3,006,288 | 10/1931 | Brown | 104/23 R X |
| 3,031,896 | 5/1962 | Walter | 184/5 |
| 3,225,228 | 12/1965 | Roshala | 104/23 FS |
| 3,233,556 | 2/1966 | McDonald | 104/89 X |
| 3,404,638 | 10/1968 | Edwards | 104/138 R X |
| 3,543,685 | 12/1970 | Rosciszewski | 104/23 R |
| 3,635,532 | 1/1972 | Zerbola | 308/5 R |
| 3,774,542 | 11/1973 | Walsh | 104/23 FS X |
| 3,888,185 | 6/1975 | Walsh | 104/89 |

*Primary Examiner*—Robert J. Spar
*Assistant Examiner*—Randolph A. Reese
*Attorney, Agent, or Firm*—George R. Nimmer

[57] ABSTRACT

An overhead transportation system comprising for a depending and longitudinally traversible vehicle an overhead trackway as a pair of longitudinally slottedly vented tubular conduits maintained above the earth's surface with a series of pillars and having an overlying protective shield. The vehicle powering means comprises a pair of co-traversible jet engines situated within respective conduits and connected to the underlying vehicle with a dual-arms hangar means along which arms the engines' fuel-line extends. The trackway is lubricated from a longitudinally extending lubeline with syncronizeably operated nozzles spaced therealong and communicating with the conduit innerwall, and a longitudinally extending troughline collects the liquid lubricant, there being provision for recycling the lubricant for high-pressure re-injection into the conduits through said lubeline nozzles.

6 Claims, 5 Drawing Figures

FIG. 1
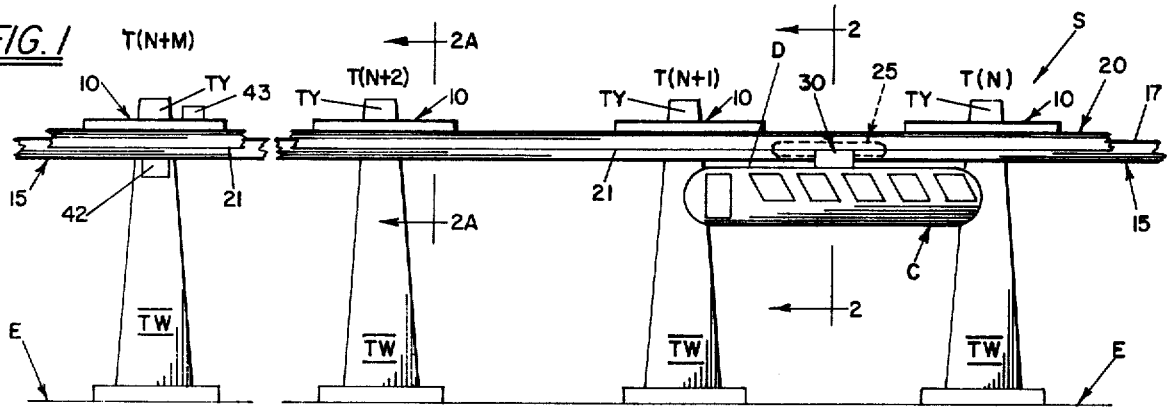
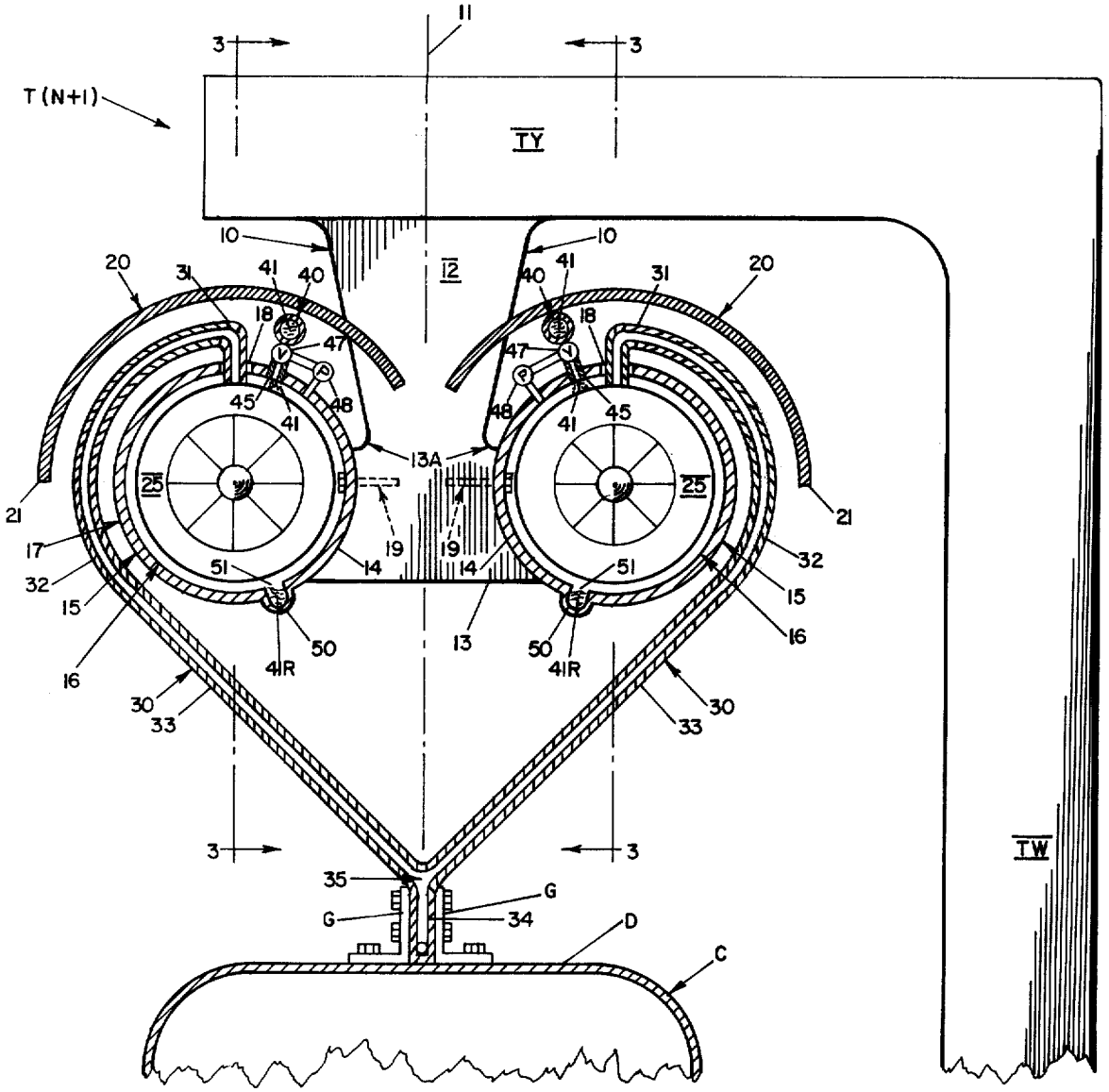
FIG. 2

FIG. 2A
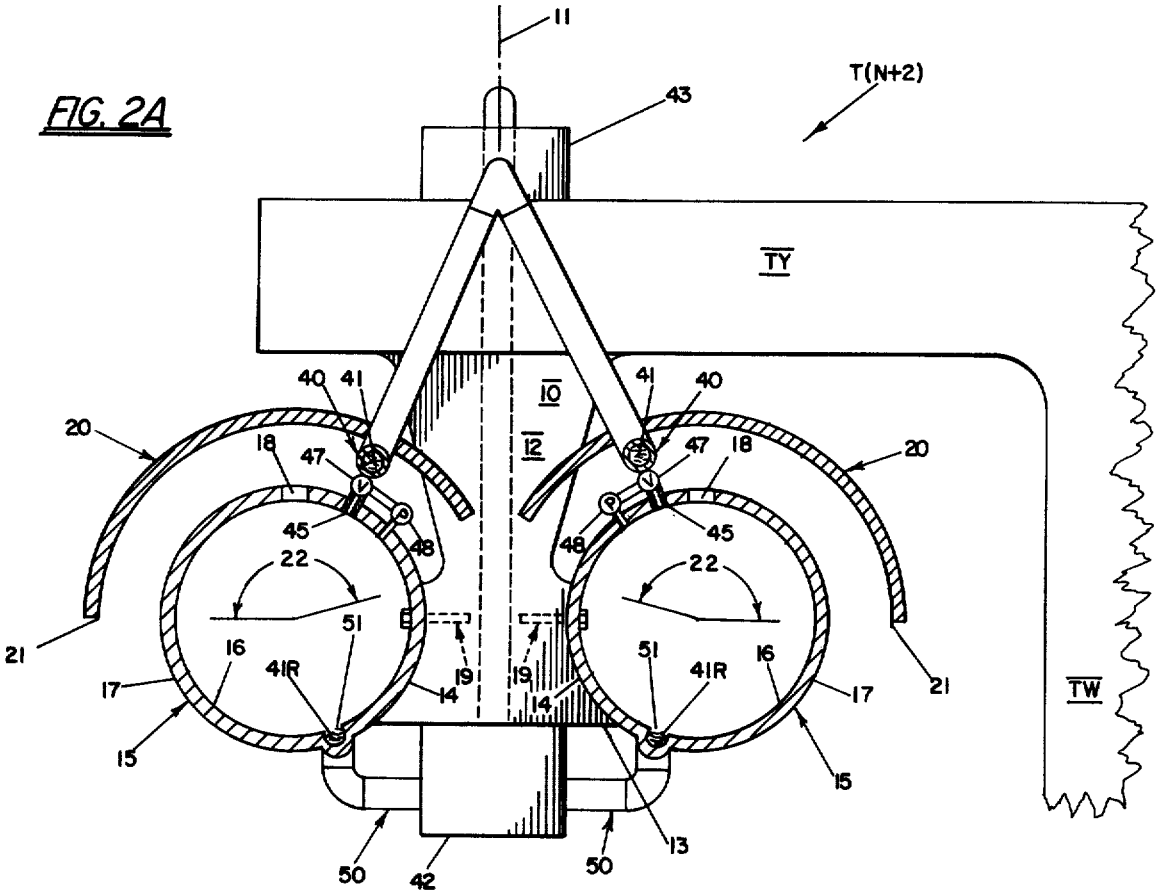
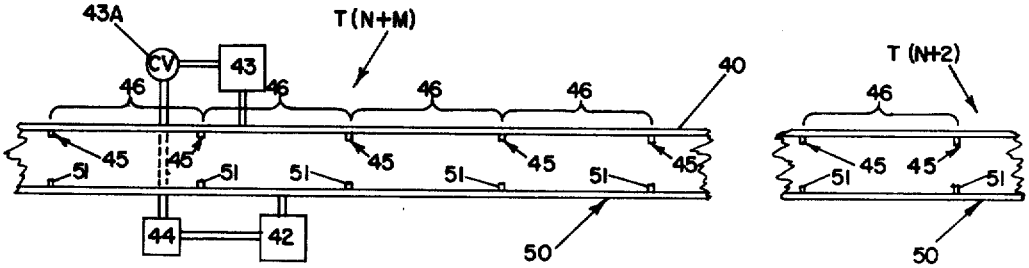
FIG. 4

TRACKWAY FOR OVERHEAD TRANSPORTATION SYSTEM

Transportation systems having a depending vehicle longitudinally traversible along an overhead trackway are taught by the prior art, including inter alia U.S. Pat. Nos. 3,225,228 (Roshala- Dec. 21, 1965) and 3,233,556 (McDonald- Feb. 8, 1966). Numerous problems have plagued prior art transportation systems including (but not limited to): the air-resistance offered to the high-speed depending vehicle and its appurtenances, providing a stable connection between the vehicle and the overhead trackway, lubrication and friction problems generally between the overhead trackway, protecting the workings of the system and particularly the trackway and powering means from weather and the ambient environment generally, and providing an aptly located efficient powering means for the traversible vehicle.

It is accordingly the general object of the present invention to provide an improved overhead trackway transportation system that overcomes noteworthy vexatious disadvantages and deficiencies attendant with prior art transportation systems, these objectives being alluded to in the accompanying drawing which depicts a representative embodiment overhead transportation system in accordance with the inventive concepts herein.

In the drawing, wherein like characters refer to like parts in the several views, and in which:

FIG. 1 is a side elevational view of a typical longitudinal length portion of the representative embodiment overhead transportation system of the present invention.

FIG. 2 is a sectional elevational view taken along line 2—2 of FIG. 1.

FIG. 2A is a sectional elevational view taken along line 2A—2A of FIG. 1.

FIG. 4 is a longitudinally extending schematic view of the multi-nozzles lubeline and the co-extensive lubricant collection trough of a preferred liquid lubrication means for the trackway.

Figure 3:
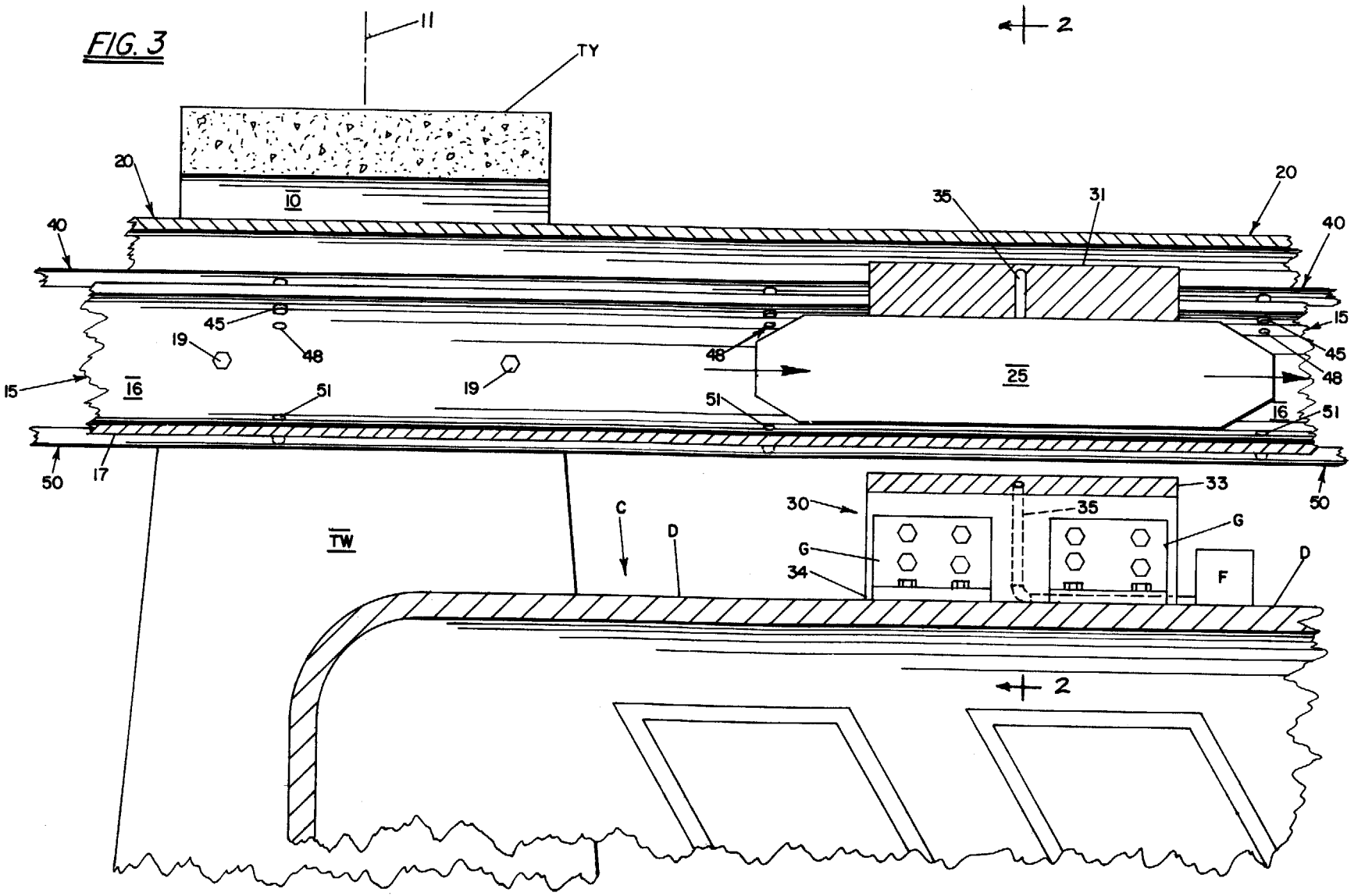
FIG. 3 is a sectional elevational view taken along line 3—3 of FIG. 2.

Generally defining the geographical pathway of the overhead transportation system S is a procession of numerous serially spaced earth-anchored pillars T each extending rigidly uprightly from the earth's surface E. For the leftwardly moving car-type vehicle C of FIG. 1, there are sequential destination pillars T(N+1), T(N+2), . . . T(N+M), in order. As best seen in FIGS. 2 and 2A, each of the pillars T is of 7-shaped cross-sectional shape including an earth-bound columnar part TW and a cross-bar part TY. Depending integrally downwardly from the cross-bar TY of each pillar T along a vertical post-axis 11 is a pillar post 10. Each pillar post as embodiment 10 is of inverted-T cross-sectional shape including a vertical spine 12 and a pair of laterally offset shoulders 13 herein including a spine-shoulder shelf 13A and an arcuate shoulder socket 14.

The overhead longitudinally extending trackway comprises a pair of substantially parallel and co-elevational tubular conduits 15 attached to the series of pillar posts 10 and located on opposite sides of the vertical post-axis 11. Preferably, each of the longitudinally elongated conduits 15 at the arcuate shoulder socket 14 nestably abuts thereat, and in this vein, each of the conduits 15 is of regular circular cross-sectional shape including an outerwall 17 and an innerwall 16. Herein, a threaded stud 19 is utilized to attach the tubular conduit internal side to pillar socket 14. The upper-hemiside of each tubular conduit 15, and preferably at the conduit cross-sectional zenith, is longitudinally continuously slottedly vented 18 whereby ambient air for the jet engines powering means can pass into slots 18 into conduits 15. Located on opposite sides of post-axis 11 is a pair of longitudinally extending protective shields 20 attached to the respective pillar posts 10 and overlying the upper-hemiside vent 18 of the respective tubular conduits 15. Thus, the protective shields might prevent snow, rain, soot, and other weather or ambient environmental elements from reaching the conduit innerwalls 16. Preferably, the respective shields 20 have a free-end sufficiently laterally remote of pillar post 10 to overlie the entire conduit upper-hemiside. And for the desireably sectorially shaped shields, the free-end 21 defines an angular value 22 from pillar post connection exceeding 90°.

There is a selectable vehicle means, preferably comprising at least one passengers-carrying car C, that is positioned beneath and longitudinally traversible along the overhead dual-conduits trackway. Depending suspended car vehicle C has a roof portion D and is provided with a fuel-tank F. The powering means for propelling the vehicle C longitudinally comprises a pair of jet engines 25 situated within and traversible along the respective tubular conduits 15. Air for the jet engines 25 enters into tubular conduits 15 through slotted vents 18, and there is a fuel-line (e.g., 35) extending branchwise from the fuel-tank (F) to the respective jet engines 25, which are preferably of identical power thrust ratings. Connecting the jet engines with the vehicle so as to render them co-traversibly movable is a dual-arms hangar means e.g., 30. The respective hangar arms 30 are located on opposite sides of post-axis 11, each arm herein having a leadward-end 31 firmly attached to the jet engine upperside and extending from said jet engine 25 through the conduit slotted vent 18. From its slot-enclosed leadward-end 31, each arm 30 extends (e.g., as 32) away from the pillar post 10, thence along the conduit external side, and finally the arm near its trailward-end is attached to the vehicle C). Herein, the two arms 30 converge downwardly from the conduit external side as arm segments 33 toward post-axis 11 and merge into a common hangar root portion 34, which root part 34 is herein attached to car roof D with angle-irons G. The branched fuel-line takes the form 35 shown i.e., located internally of the hangar means elements 30–34.

At this juncture, it can be readily appreciated that lubrication of the conduits innerwall 16 is desirable to reduce friction between the conduit 15 and the jet engine 25. Preferably, liquid lubricant 41 is injected 45 under high-pressure toward the conduit innerwall 16 in timed synchronization with approach of the jet engine, as by utilizing a pressure-gauge 48 or analagous means for sensing the approach of the jet engine at a nozzle-station 45. For example, a lubeline 40 for carrying liquid lubricant 41 is attached to and is longitudinally co-extensive with each conduit outerwall 17. The liquid lubricant 41 might flow from a reservoir 42 via gear pump 44 to a high-pressure main-pump 43 (having check valve 43A), whereupon the lubricant is introduceably injected under high-pressure into lubeline 40. Nozzles 45 passing downwardly through conduits 15 are utilized for injecting high-pressure lubricant 41 toward innerwalls 16, there being a plurality of nozzle-stations 45 between consecutive pillars T and preferably spaced at regular -intervals 46 therealong. Synchronization of the lubricant injection e.g., 42 as the jet engine 25 approaches a nozzle-station might be with a convenient sensing means (e.g. 48) which can momentarily actuate a valve means (e.g. 47) positioned between the lubeline 40 and each nozzle 45.

There is desireably means for recycling the liquid lubricant 41 which had already been utilized at the conduit innerwall 16. For recycling, one reservoir 42 and one high-pressure pump 43 might serve numerous nozzle-stations 45 along some finite-length of the overhead trackway 15. Spaced at increments along the lower-hemiside of each conduit 15 are drainage ports 51 for collecting re-cyclable oil lubricant 41R. Shown is a troughline 50 coextensive along the underside of and attached to each conduit 15, and communicating with ports 51. The oil 41R then flows along troughline 50 to the nearest oil reservoir 42, which lubricant is re-introduced under high-pressure (as by pump 43) into lubeline 40 for re-injection 45 into conduits 15.

From the foregoing, the construction and operation of the overhead trackway transportation concepts will be readily understood and further explanation is believed to be unnecessary. However, since numerous modifications and changes in these concepts will readily occur to those skilled in the art, it is not desired to limit the invention to the exact construction shown and described, and accordingly, all suitable modifications and equivalents may be resorted to, falling within the scope of the appended claims.

I claim:

1. A trackway for an overhead transportation system of the general class comprising at least one car as a vehicle means depending from and longitudinally traversible along a trackway that is located above the earth's surface including a series of spaced pillars and each pillar having a post depending downwardly therefrom along a vertical post-axis, said transport system trackway comprising:

A. a pair of substantially parallel and co-elevational tubular conduits attached to a series of pillar posts and located on opposite sides of the vertical post-axis, the upper-hemiside of each conduit being longitudinally slottedly vented therethrough;

B. a pair of protective shields attached to the respective pillar posts and located on opposite sides of the vertical post-axis, each of said protective shields being longitudinally coextensive along and protectively overlying the upper-hemiside vent slots of the respective tubular conduits;

C. at least one lubeline coextensive along the outerwall of the respective tubular conduits and having serially spaced nozzles for high-pressure injection of lubricant fluid from each nozzle-station toward the conduit innerwall and operatively synchronizeable with the approaching vehicle;

D. a troughline coextensive along the lower-hemiside of and communicating with the innerwall of the respective tubular conduit for collection of the lubricant; and E. means for recycling the lubricant fluid from the troughline back to the lubeline, said recycling means including a lubricant reservoir along the troughline and pump means for reintroducing the lubricant under high pressure into the lubeline.

2. The overhead transportation system of claim 1 wherein each of the protective shields overlies the entire respective tubular conduits; and wherein there is a plurality of nozzle-stations between neighboring pillars and spaced at regular-intervals along the lubeline.

3. The overhead transportation system of claim 2 wherein the tubular conduits are of circular cross-sectional shape; wherein each of the protective shields externally of the pillar post is of sectorial cross-sectional shape having an arcuate extent of more than 90°.

4. The overhead trackway system of claim 3 wherein the arcuate internal side of the respective conduits nestably abuts against and is attached to the pillar post; and wherein the lubricant injection by each nozzle into the conduit is synchronized acccording to the increasing pressure exerted by the oncoming jet engine.

5. The overhead trackway transportation system of claim 1 wherein the tubular conduits are of circular cross-sectional shape; and wherein there is a plurality of nozzle-stations between consecutive neighboring pillars and spaced at regular-increments along the lubeline.

6. The overhead trackway system of claim 1 wherein the serially spaced pillars are of 7-shaped cross-sectional shape including an earth-bound columnar part and a cross-bar from which the pillar post integrally depends; wherein the two conduits nestably abut against and are attached to opposite sides of said depending pillar post; and wherein the conduit slotted vents are located at the zenith of the conduit upper-hemiside and also located below and spatially separated from said overlying protective shields.

* * * * *